US005357921A

United States Patent [19]

Katoh et al.

[11] Patent Number: 5,357,921

[45] Date of Patent: Oct. 25, 1994

[54] CYLINDER BLOCK AND A PROCESS FOR CASTING THE SAME

[75] Inventors: Hisashi Katoh, Saitama; Tadayoshi Nakajima; Tomoyuki Goto, both of Mie; Tsunehisa Hata; Hideyo Miyano, both of Saitama; Shinsuke Koda, Tochigi, all of Japan

[73] Assignee: Honda Giken Kogyo Kabushiki Kaisha, Tokyo, Japan

[21] Appl. No.: 456

[22] Filed: Jan. 4, 1993

[30] Foreign Application Priority Data

Jan. 6, 1992 [JP] Japan ..... 4-000310
Jan. 6, 1992 [JP] Japan ..... 4-000311
Jan. 9, 1992 [JP] Japan ..... 4-002474

[51] Int. Cl.[5] ..... F02F 1/00
[52] U.S. Cl. ..... 123/193.2; 29/888.061
[58] Field of Search ..... 123/193.2, 41.74, 668, 123/193.1; 29/888.06, 888.061, 527.5; 164/98, 112

[56] References Cited

U.S. PATENT DOCUMENTS 1,528,947 3/1925 Preston ..... 29/888.061
2,098,451 11/1937 Gilmore .
2,331,554 10/1943 Irgens ..... 29/888.061
4,221,196 9/1980 Castarede ..... 123/193.2
4,394,850 7/1983 Hayashi ..... 123/193.2
4,520,768 6/1985 Shimonosono et al. ..... 123/193.2
4,708,105 11/1987 Leydorf et al. ..... 123/41.84
4,903,652 2/1990 Field et al. ..... 123/193.2
5,005,469 4/1991 Ohta ..... 123/41.84
5,095,868 3/1992 Brighigna ..... 123/193.2

FOREIGN PATENT DOCUMENTS 0936347 11/1973 Canada ..... 29/888.061
0145393 6/1985 European Pat. Off. .
0411785 2/1991 European Pat. Off. .
3741838 6/1988 Fed. Rep. of Germany .

*Primary Examiner*—Tony M. Argenbright
*Assistant Examiner*—M. Macy
*Attorney, Agent, or Firm*—Lyon & Lyon

[57] ABSTRACT

A cylinder block has a cylinder block body and a cylinder liner block mounted by casting in the cylinder block body. The cylinder liner block is formed from a material having a rigidity larger than that of the cylinder block body, and the cylinder liner block comprises a liner section mounted by casting in position in a cylinder barrel portion of the cylinder block body, and a reinforcing wall section mounting by casting in position in a bearing wall of a crank case portion of the cylinder block body in a. Thus, it is possible to increase the wear resistance of cylinders in the cylinder block, as well as to provide an increase in performance by reductions in vibration and noise of the engine including the cylinder block, and to provide reductions in size, weight and cost of the cylinder block by a reduction in thickness of the bearing walls.

11 Claims, 13 Drawing Sheets

CYLINDER BLOCK AND A PROCESS FOR CASTING THE SAME

BACKGROUND OF THE INVENTION

1. Field of the Invention

The present invention relates to a cylinder block for an internal combustion engine and a process for casting the same.

2. Description of the Prior Art

A cylinder block for an internal combustion engine is produced by a high pressure casting process such as a die casting process. In such a case, a cylinder liner block defining cylinders in the cylinder block is formed with cylinder liners of into a cylindrical shape and mounted in a cylinder barrel portion of a cylinder block body which forms a main portion of the cylinder block (see Japanese Utility Model Publication No. 28289/89).

The conventional cylinder liner block is formed mainly for the purpose of increasing the wear resistance of the cylinder in which a piston slides, but this cylinder liner block does not contribute to an increase in rigidity of the cylinder block itself and particularly to an increase in rigidity of a bearing wall which supports a crankshaft in a crank case portion of the cylinder block.

The conventional cylinder block body is formed into a complicated shape having a cylinder barrel portion including a plurality cylinders, and a crank case portion formed with a plurality of bearing walls for supporting the crankshaft. Therefore, the cylinder block body has both thin and thick portions and hence, it is difficult to make the chilling or solidifying rate uniform over the entire region during solidification of the cylinder block. For example, a base portion of the bearing wall for supporting the crankshaft is formed thick and hence, has a volume larger than those of other portions, thereby bringing about casting defects such as sink marks due to solidification shrinkage effects.

Thus, in order to prevent such casting defects, there has been conceived an approach for partially accelerating the solidifying rate by additionally using a chiller metal portion or other partially chiller means. However, such an approach results in complicated casting equipment and process, thereby bringing about an increase in cost.

Further, in the prior art casting process, in order to form a water jacket directly surrounding an outer peripheral surface of the cylinder liner block and particularly a water jacket having an undercut portion, a core such as a sand core must be used.

SUMMARY OF THE INVENTION

Accordingly, it is a first object of the present invention to provide a new cylinder block in which a cylinder liner block not only has an intrinsic function but also as well as contributes to an increase in rigidity of the cylinder block itself and, particularly, of the bearing wall of the crank case portion thereof and further to an increase in performance of an internal combustion engine and to reductions in size and cost.

To achieve the above object, according to an aspect and feature of the present invention, there is provided a cylinder block comprising a cylinder block body and a cylinder liner block mounted by casting in the cylinder block body, the cylinder liner block being formed from a material having a rigidity larger than that of the cylinder block body, and the cylinder liner block comprising a liner section mounted by casting in a cylinder barrel portion of the cylinder block body and a reinforcing wall section mounted by casting in a bearing wall of a crank case portion of the cylinder block body.

With the above arrangement, the cylinder liner block can provide not only an increase in the wear resistance of cylinders in the cylinder block, but also a substantial increase in the rigidity of the bearing walls, which contributes to reductions in vibration and noise of the cylinder block and to an increase in performance of an engine. In addition, this arrangement makes it possible to reduce the thickness of the bearing walls of the crank case portion, thereby contributing to reductions in size, weight and cost of the cylinder block.

It is a second object of the present invention to provide a new cylinder block in which a portion of the cylinder liner block mounted by casting in the cylinder block body can be utilized as a chiller metal portion during casting.

To achieve the above object, according to a second aspect and feature of the present invention, there is provided a cylinder block comprising a cylinder liner block mounted in a cylinder block body to define a plurality of cylinder bores, the cylinder liner block including cylinder liners, the adjacent cylinder liners being connected in series by a common boundary wall which is integrally provided with a chiller metal portion having a chiller fin and extending from the boundary wall, the chiller metal portion being mounted by casting in a thick wall portion of the cylinder block body.

With the above arrangement, a portion of the cylinder liner block mounted by casting in the cylinder block body can be utilized as a chiller metal during casting so as to prevent the generation of casting defects, and the chiller fin providing an anchoring effect between the cylinder block body and the cylinder liner block. Thus, it is possible to provide a multi-cylinder block having a high accuracy and a high quality at a low cost as a whole.

It is a third object of the present invention to provide a new process for casting a cylinder block, wherein a cylinder block can be formed without use of a core, even when there is an undercut portion in an outer peripheral surface of a cylinder liner block, and moreover, a cylinder block of a reduced weight and a high accuracy can be produced without charging the molten metal in unnecessary areas.

To achieve the above object, according to a third aspect and feature of the present invention, there is provided a process for casting a cylinder block comprising a hollow cylindrical liner mounted in a cylinder block body to define a hollow cylinder bore, and a water jacket defined around an outer periphery of the cylinder liner block and opened at a deck surface of the cylinder block body, the process comprising steps of: integrally and projectingly providing a seal flange around an outer periphery of a lower portion of the cylinder liner; setting the cylinder liner in a mold for forming the cylinder block body; fitting an outer the cylinder liner in a hollow cylindrical jacket projection formed in the mold so as to mate a free end of the jacket projection to a sealing surface of the seal flange; and pouring molten metal under a pressure into a cavity defined by the mold and the cylinder liner, thereby casting the cylinder block body width the cylinder liner mounted therein.

With the above process, it is possible to shape the water jacket in the cylinder block with a high degree of accuracy without use of a core, and to shape the water jacket opened at the deck surface without any hindrance, even if there is an undercut in the cylinder liner. Further, the molten metal need not be charged in wasteful spaces, thereby achieving reductions in weight and cost of the cylinder block itself.

The above and other objects, features and advantages of the invention will become apparent from the following description of a preferred embodiment, taken in conjunction with the accompanying drawings.

DESCRIPTION OF THE PREFERRED EMBODIMENT

Figure 1:
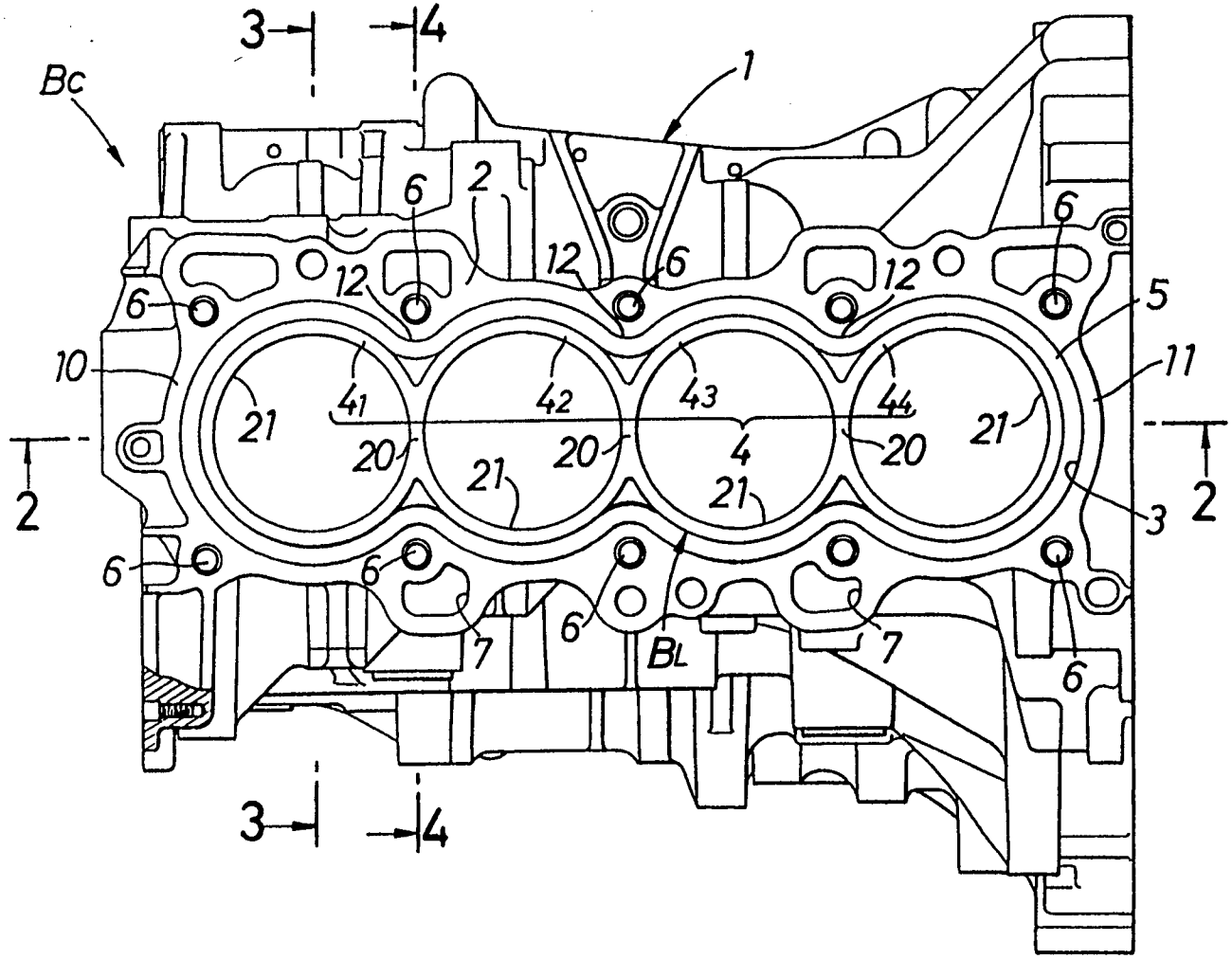
FIG. 1 is a plan view of a cylinder block according to the present invention.
Figure 2:
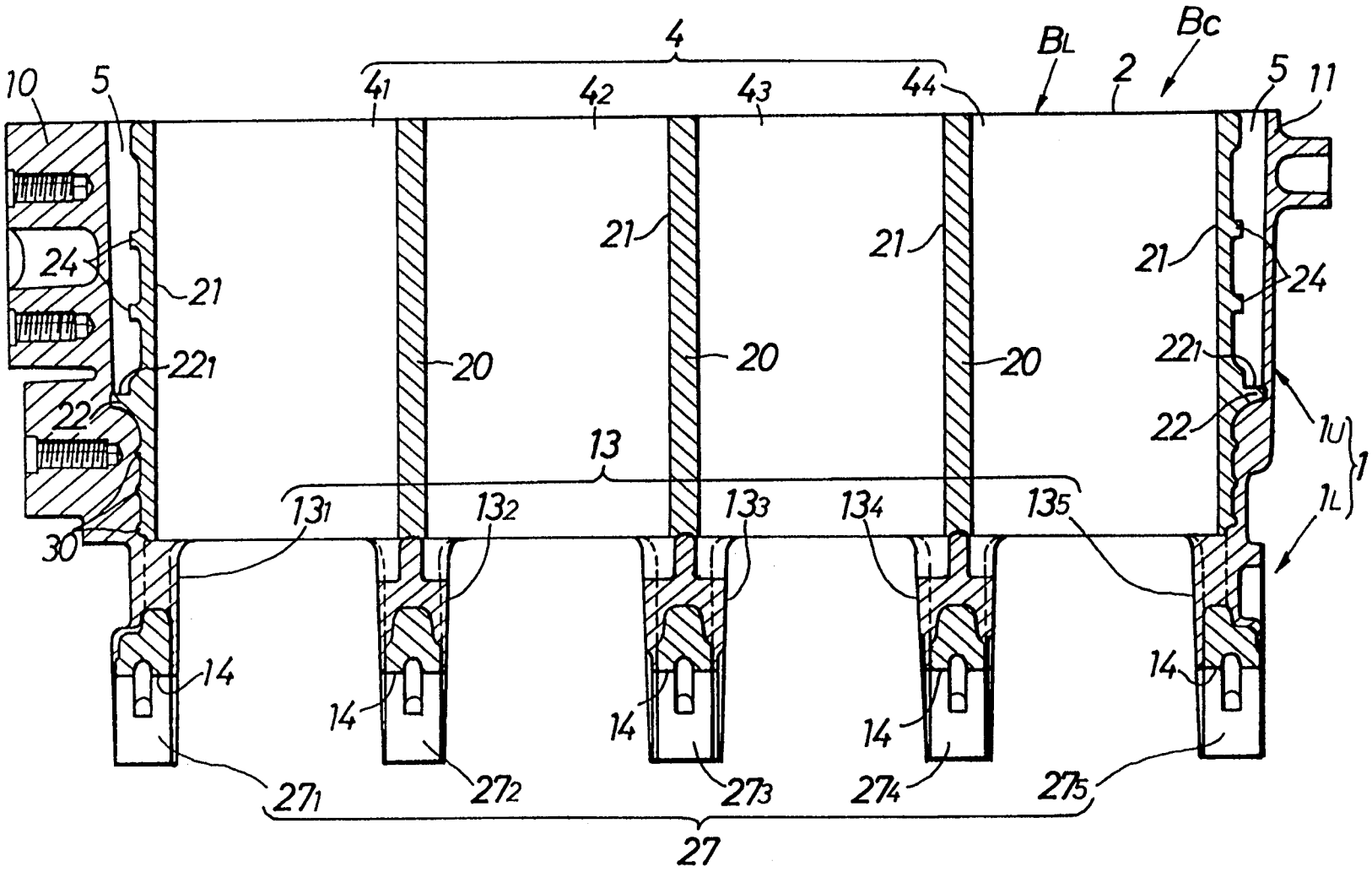
FIG. 2 is a sectional view taken along a line 2—2 in FIG. 1.
Figure 3:
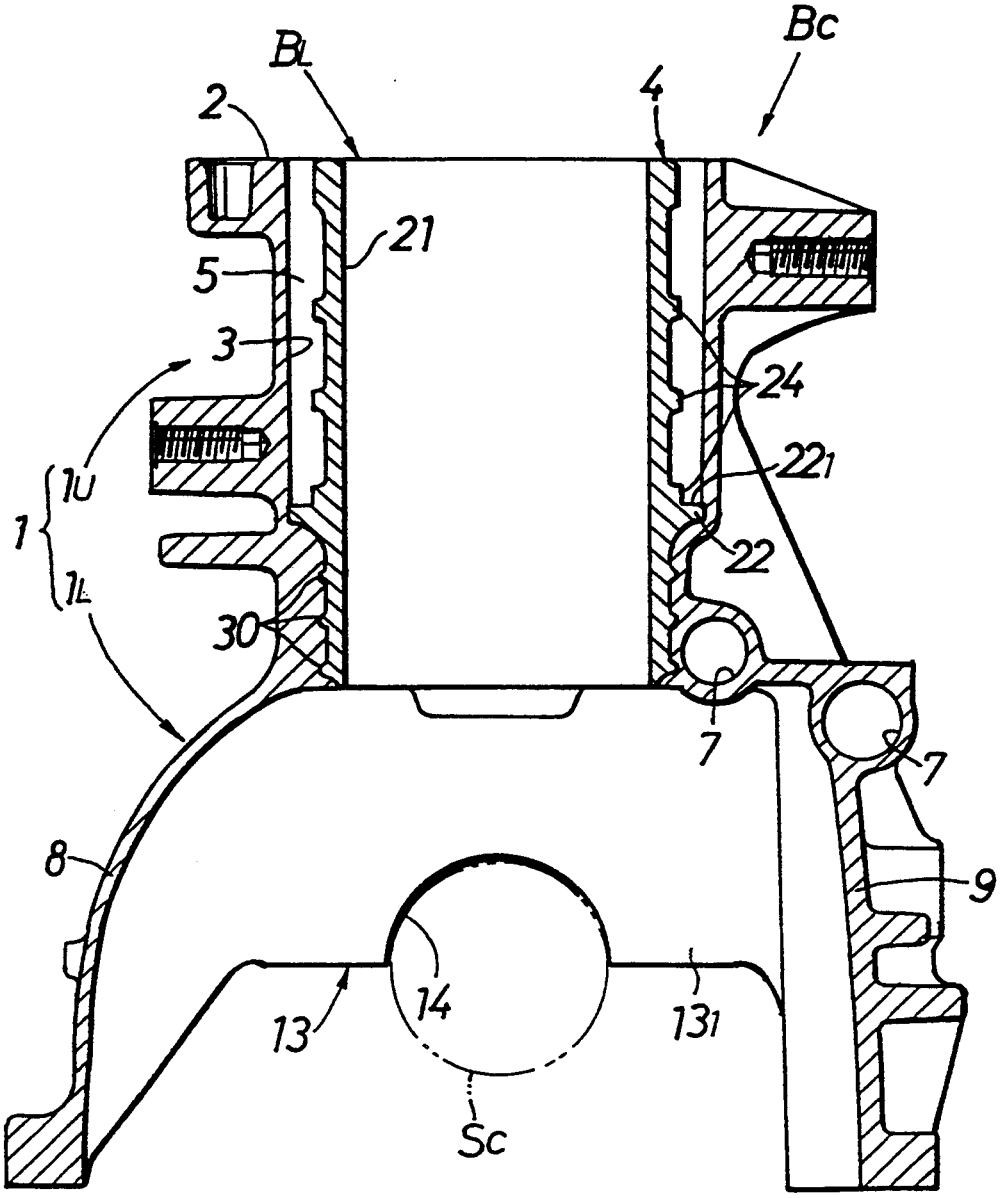
FIG. 3 is a sectional view taken along a line 3—3 in FIG. 1.

The present invention will now be described by way of a preferred embodiment in connection with the accompanying drawings.

A cylinder block $B_c$ for a serial four-cylinder internal combustion engine is constructed as an open deck type having a quadruple wet cylinder liner block $B_L$. A cylinder block body 1 forming a main portion of the quadruple wet cylinder liner block $B_L$ is made by a diecasting of aluminum alloy.

The cylinder block body 1 is comprised of an upper portion, i.e., a cylinder barrel portion $1_u$ and a lower portion, i.e., a crank case portion $1_L$. The upper portion 1 u is provided with a quadruple barrel bore 3 opened at a deck surface 2 of the cylinder block body 1. A liner section 4 of the quadruple wet cylinder liner block $B_L$ made of cast iron which will be described hereinafter is integrally mounted, by casting, in the barrel bore 3. The liner portion 4 of the cylinder liner block $B_L$ is comprised of first, second, third and fourth wet liners $4_1$, $4_2$, $4_3$ and $4_4$ connected to one another. A cylinder bore 21, in which a piston (not shown) is slidably received, is made in each of the wet liners $4_1$, $4_2$, $4_3$ and $4_4$.

A water jacket 5 is defined between an outer wall surface of the quadruple wet cylinder liner block $B_L$ and an inner wall surface of the barrel bore 3 and is opened at the deck surface 2. As usual, cooling water is circulated through the water jacket 5.

Provided in an outer wall of the cylinder barrel portion $1_u$ are a bolt bore 6 for mounting a cylinder head (not shown) on the deck surface 2, an oil passage 7 through which lubricating oil flows, and the like.

The crank case portion $1_L$ constituting the lower portion of the cylinder block body 1 includes left and right skirt walls 8 and 9 integrally extending from a lower portion of the cylinder barrel port[on $1_u$, and a plurality of first, second, third, fourth and fifth bearing walls $13_1$, $13_2$, $13_3$, $13_4$ and $13_5$ provided to extend downwardly from constricted portions 12 between longitudinally opposite end walls 10 and 11 of the cylinder barrel portion $1_u$ and the first to fourth wet liners $4_1$, $4_2$, $4_3$ and $4_4$ so as to integrally connect the left and right skirt walls 8 and 9 with each other. First, second, third, fourth and fifth reinforcing walls $27_1$, $27_2$, $27_3$, $27_4$ and $27_5$ (which will be described hereinafter) of the crank case portion $1_L$ of the cylinder liner block $B_L$ are mounted by casting in the bearing walls $13_1$, $13_2$, $13_3$, $13_4$ and $13_5$, respectively, and provided with a semi-circular bearing bore 14 for supporting a crankshaft $S_c$, of the engine a pair of bolt bores 15 for use in mounting a bearing cap (not shown) on a lower surface thereof, and the like.

The structure of the quadruple wet cylinder liner block $B_L$ of cast iron which is integrally mounted by casting in the cylinder block of aluminum alloy during the production of the cylinder block $B_c$ in the die casting process will be described in detail with reference to FIGS. 5 to 11.

The quadruple wet cylinder liner block B L includes a liner section 4 and a reinforcing wall section 27. The liner section 4 is comprised of the first, second,; third and fourth four cylindrical wet liners $4_1$, $4_2$, $4_3$ and $4_4$ connected to one another, with the adjacent wet liners being connected through a common boundary wall 20 and therefore, they are formed into a so-called siamese type. The cylinder bore 21, in which the piston (not shown) is slidably received, is made in each of the wet liners $4_1$, $4_2$, $4_3$ and $4_4$.

Figure 5:
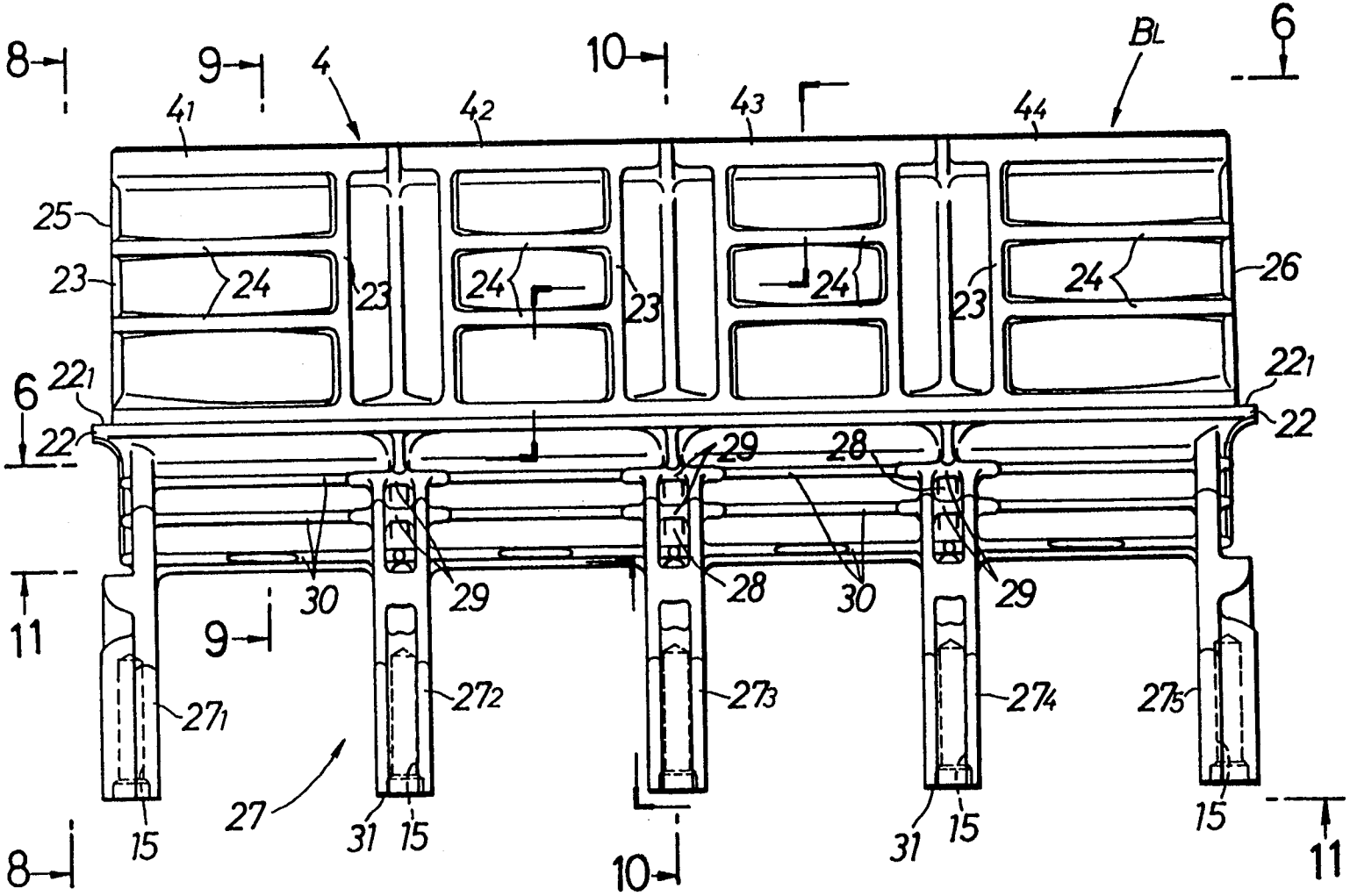
FIG. 5 is a front view of a quadruple wet liner block.
Figure 6:
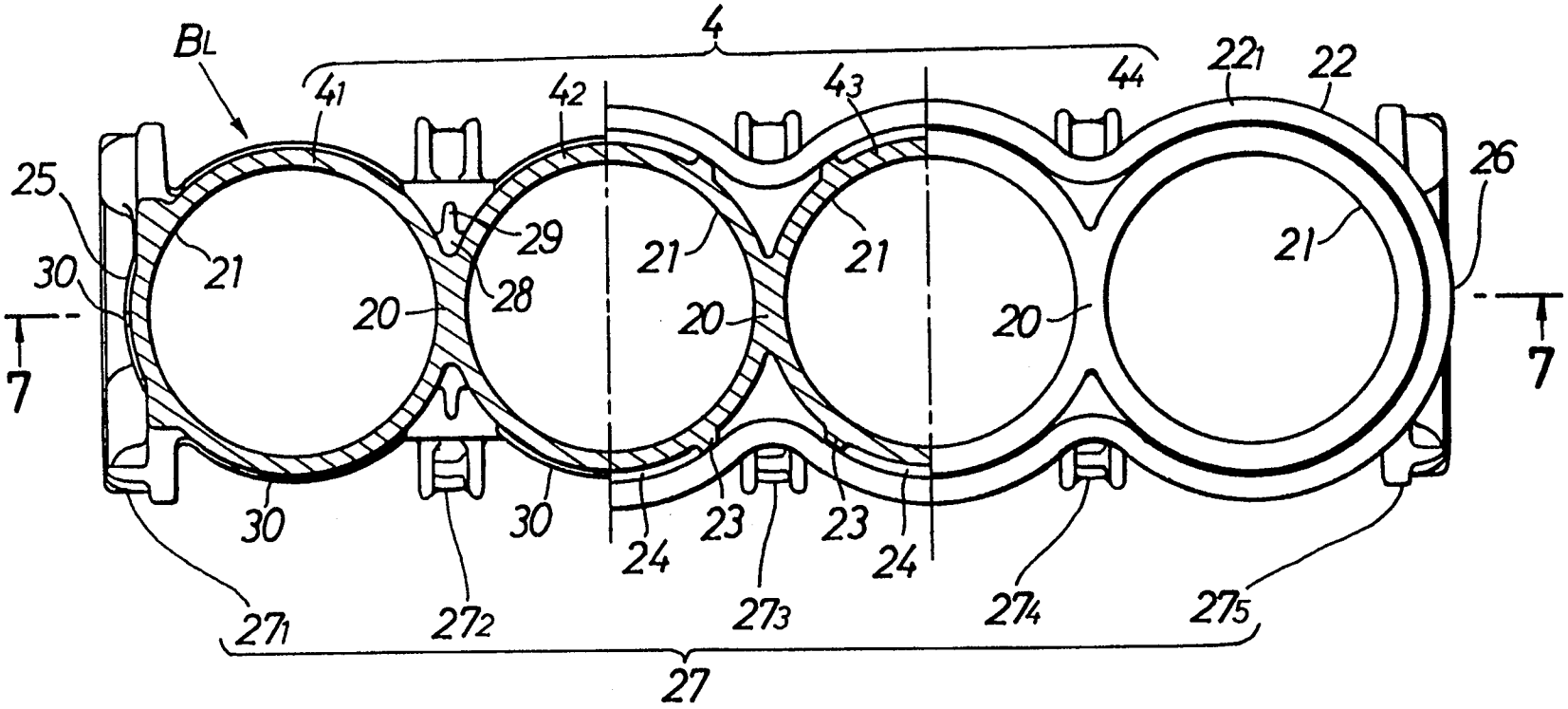
FIG. 6 is a partially cross-sectional plan view taken along a line 6—6 in FIG. 5.
Figure 7:
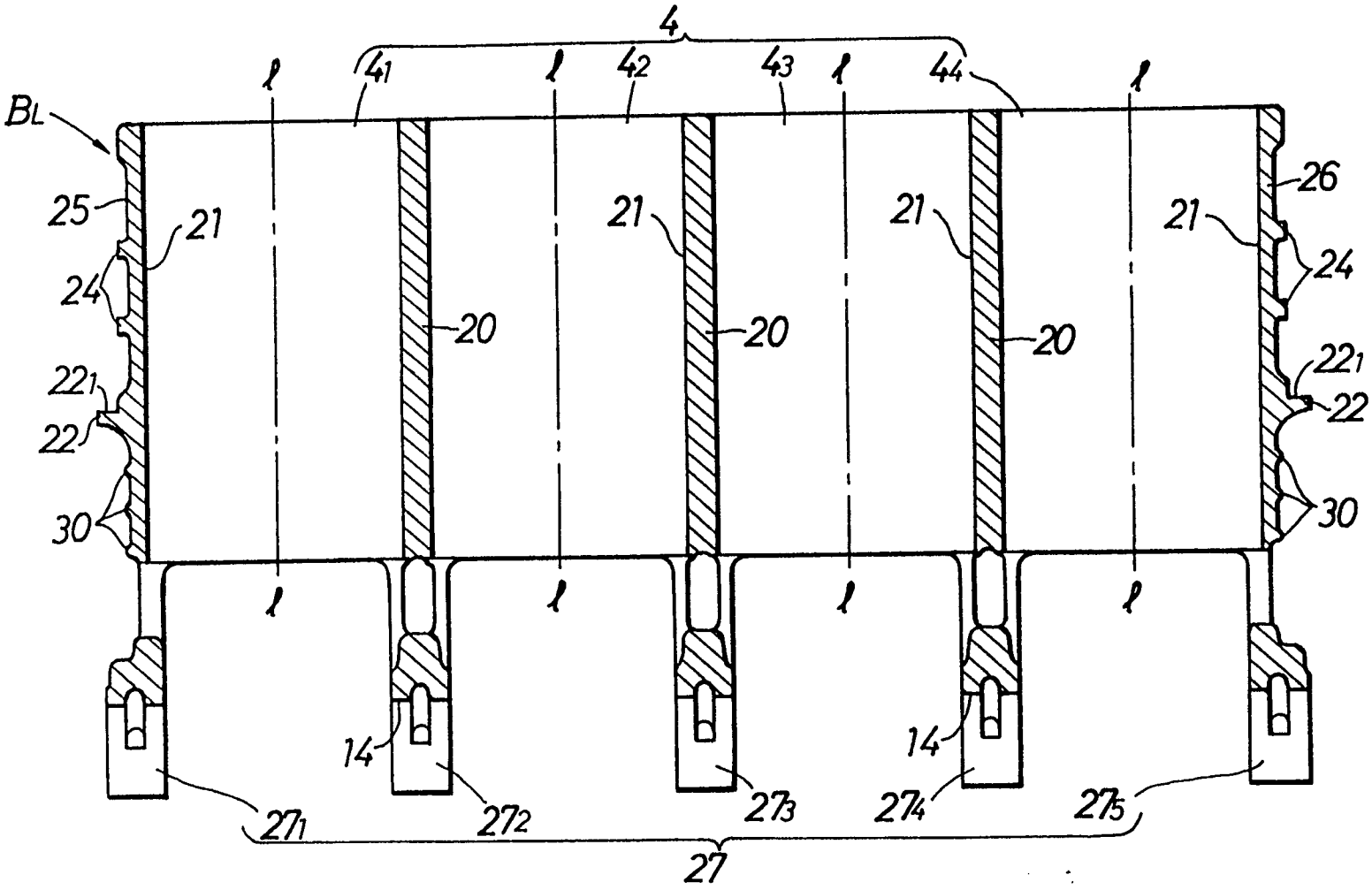
FIG. 7 is a sectional view taken along a line 7—7 in FIG. 6.
Figure 8:
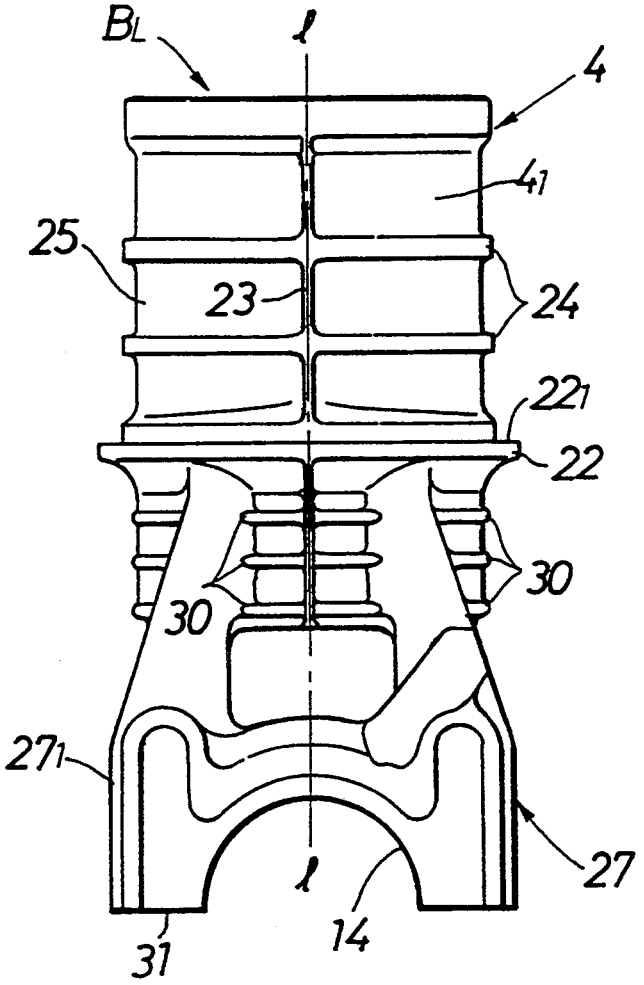
FIG. 8 is an elevation view taken along a line 8—8 in FIG. 5.
Figure 9:
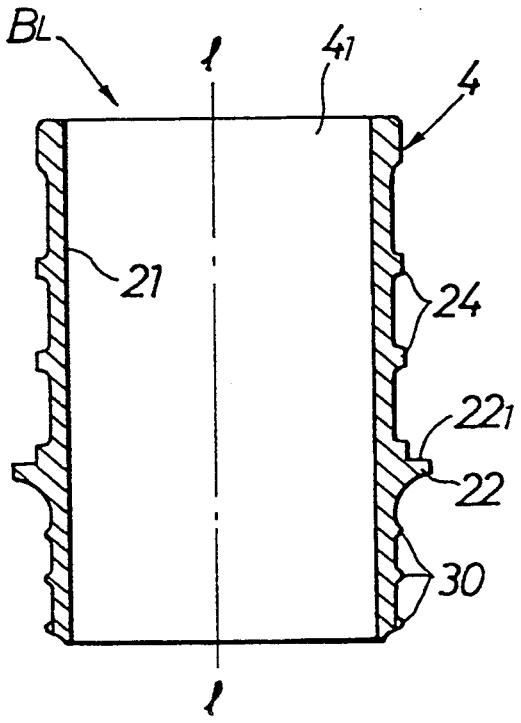
FIG. 9 is a sectional view taken along a line 9—9 in FIG. 5.

As best shown in FIGS.5, 8 and 9, a seal flange 22 is integrally formed on an outer periphery of a lower portion of the liner section to extend over the entire periphery substantially horizontally in a direction substantially perpendicular to a cylinder axis 1—1, and an upper surface of the seal flange 22 is formed into a flat sealing surface $22_1$.

Longitudinal and transverse ribs 23 and 24 as a spacer and a reinforcing member are integrally provided around an outer periphery of the liner section 4 above the seal flange 22. Each of these ribs 23 and 22 are formed at a height lower than that of the seal flange 22. A plurality of reinforcing small ribs 30 are integrally provided on a portion of the liner section 4 at a location lower than the seal flange 22 to project therefrom substantially in parallel to the seal flange 22.

The reinforcing wall section 27 of the crank case portion 1 L of the cylinder liner block $B_L$ is comprised of the first to fifth reinforcing walls $27_1$ to $27_5$ integrally juxtaposed to extend in parallel to one another from lower portions of the boundary walls 20 provided between the longitudinally opposite end walls 25 and 26 and the first to fourth four cylindrical wet liners $4_1$ to $4_4$ of the liner section 4. These reinforcing walls $27_1$ and $27_5$ are integrally mounted by casting in the first to fifth bearing walls $13_1$ to $13_5$, respectively. Each of the reinforcing walls $27_1$ to $27_5$ is provided at its lower surface with a bolting surface 31, the bearing bore 14 and the bolt bores 15 for boding a bearing cap (not shown).

Figure 10:
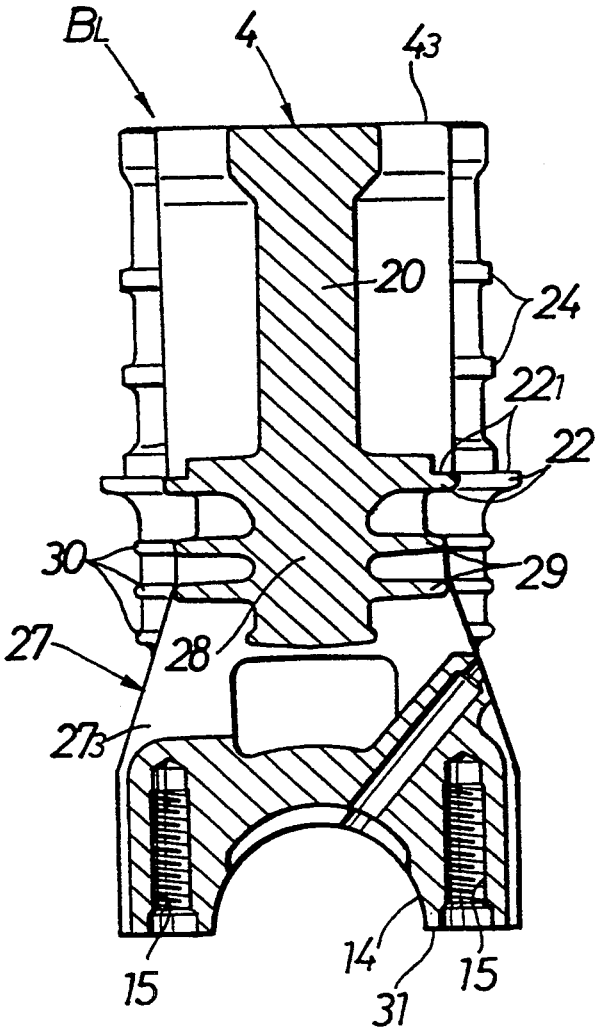
FIG. 10 is a sectional view taken along a line 10—10 in FIG. 9.
Figure 11:
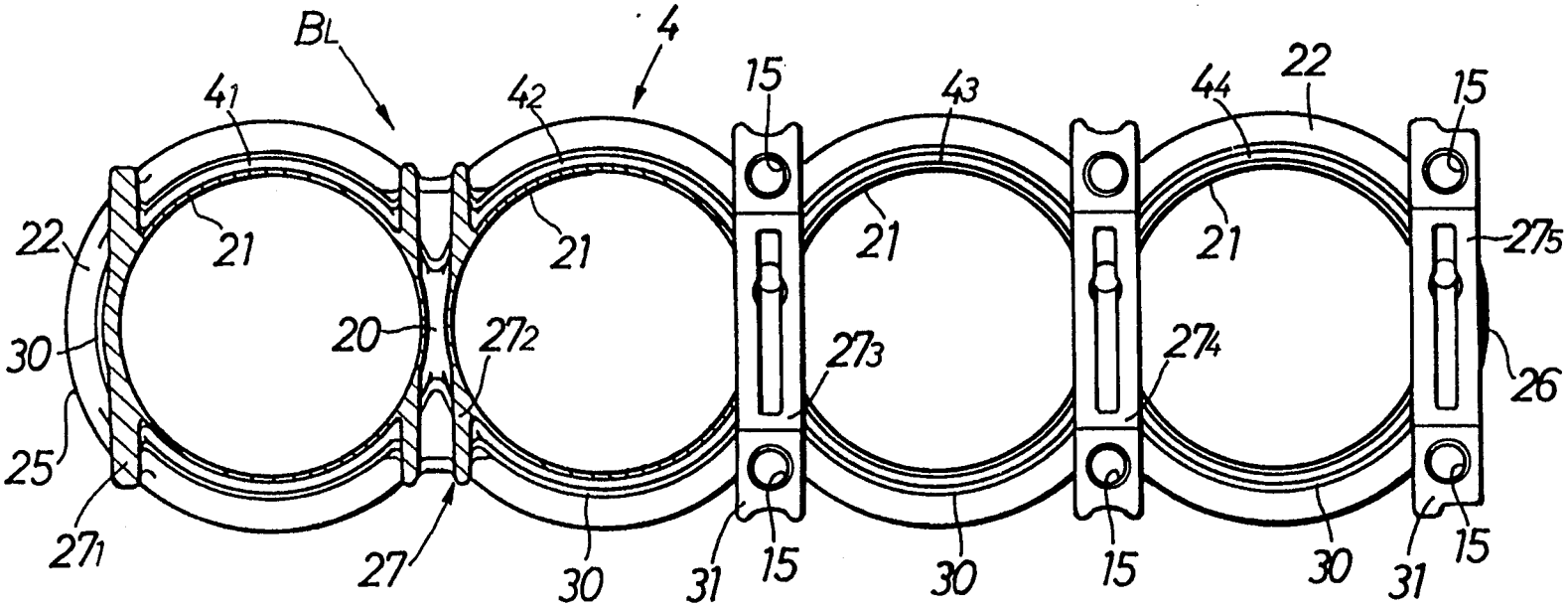
FIG. 11 is a partially cross-sectional bottom view taken along a line 11—11 in FIG. 5.

As shown in FIG.10, the boundary walls 20 of the liner section 4 and the first to fifth reinforcing walls $27_1$ to $27_5$ are integrally interconnected by connecting walls 28, respectively. The connecting wall 28 is made thick in a widthwise direction so as to insure a relative large volume. A plurality of relatively long heating-absorbing chiller fins 29 are projectingly provided on an outer periphery of the connecting wall 28. The connecting wall 28 of the large volume serves as a chiller metal portion to improve the cooling rate during solidification of the molten aluminum alloy during the die casting production of the cylinder block $B_c$ of the aluminum alloy.

Figure 12:
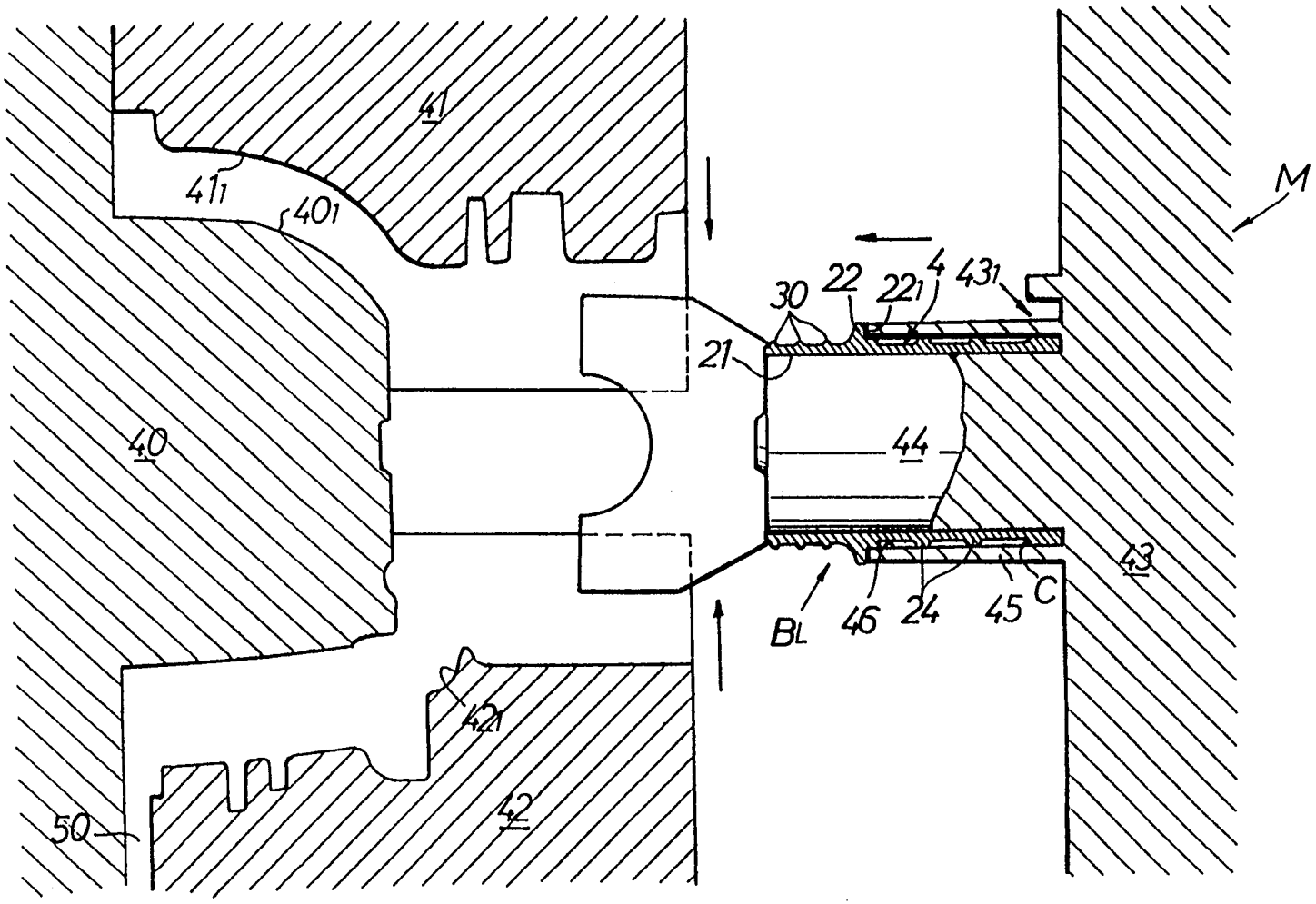
FIGS. 12 to 14 are views illustrating steps for casting a cylinder block in a metal mold.
Figure 13:
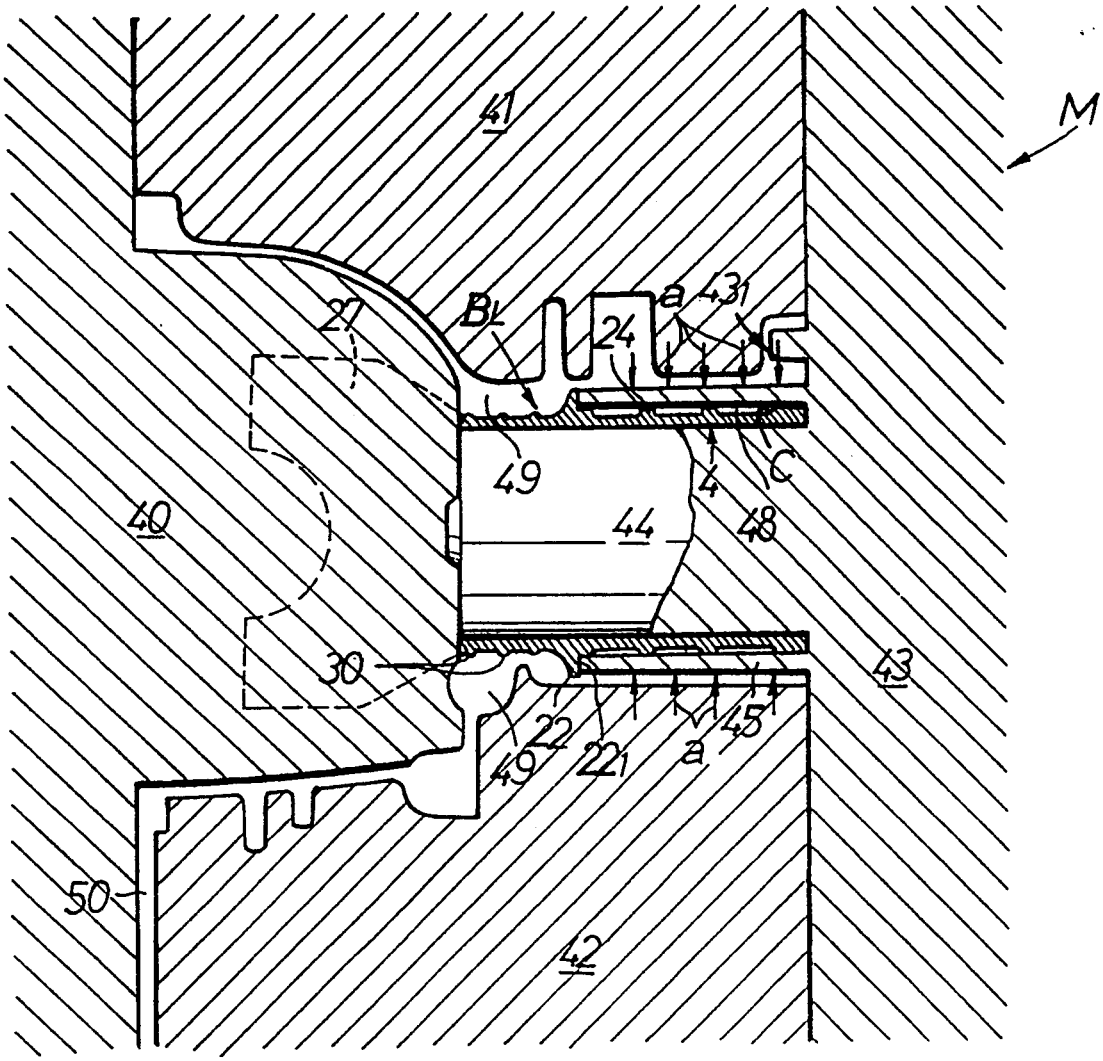
Figure 14:
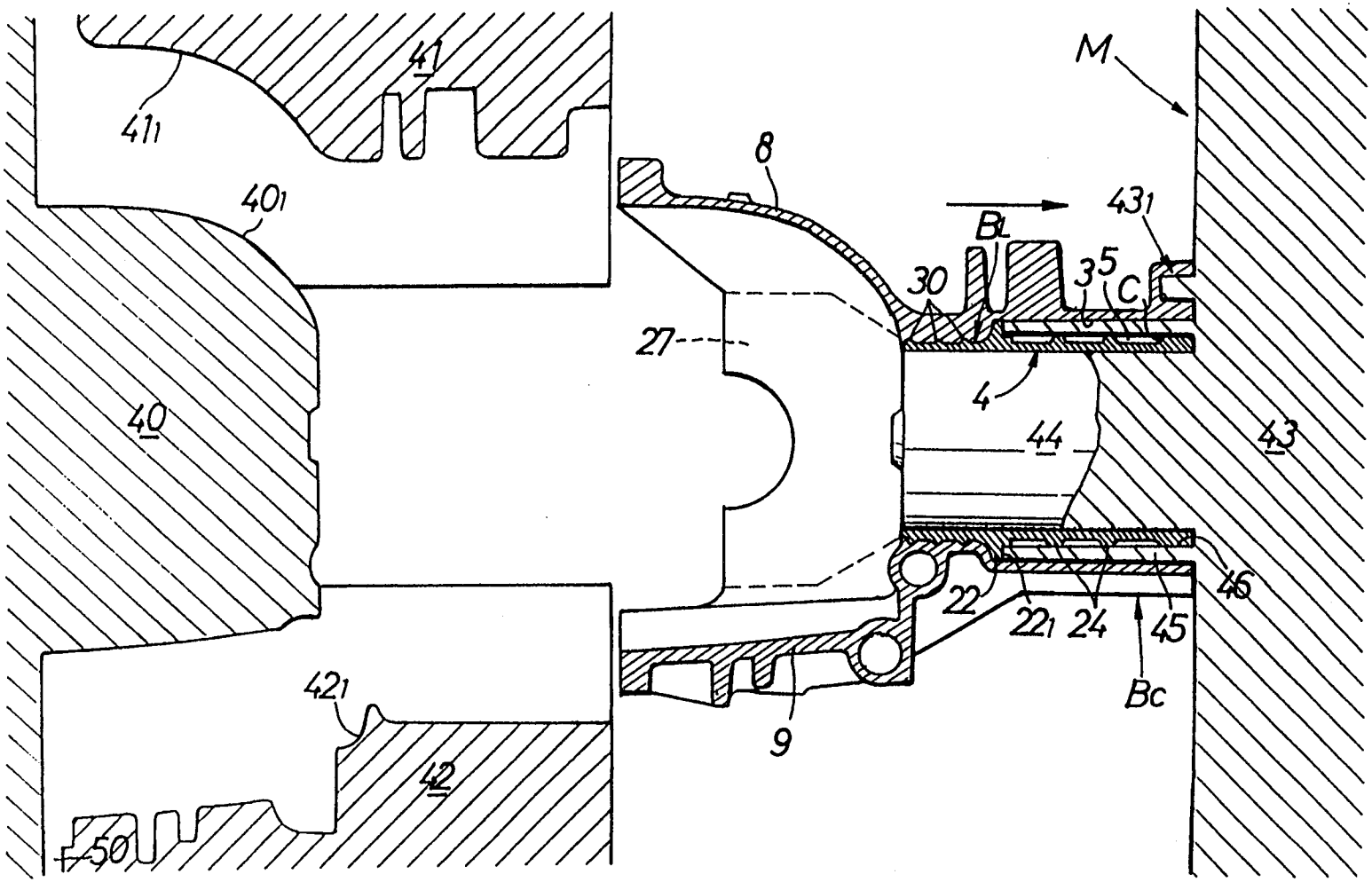

A metal mold for producing the cylinder block Be in the die-casting process and steps for casting the same are shown in FIGS. 12 to 14.

Referring to these Figures, the metal mold M is comprised of a stationary die 40, top and bottom movable dies 41 and 42 capable of being moved vertically toward and away from each other, and a side movable die 43 capable of being moved laterally relative to the stationary die 40. The stationary die 40 is provided with a shaping surface $40_1$ formed into a convex shape. The top and bottom movable dies 41 and 42 have shaping surfaces $41_1$ and $41_2$ formed thereon in an opposed relation to each other. The side movable die 43 has a shaping surface $43_1$ formed in an opposed relation to the shaping surface $40_1$ of the stationary die 40. The shaping surface $43_1$ has cylindrical bore pins 44 dependingly provided thereon in a longitudinal arrangement for defining the cylinder bores 21. A hollow cylindrical jacket projection 45 is integrally provided in a depending manner to surround each of the bore pins 44 with an annular clearance 46 left therebetween and extends to the halfway of the bore pin 44.

As shown in FIGS. 12 and 13, the cylinder bore 21 in the cylinder liner block $B_L$ is fitted over each bore pin 44 from the left thereof. The wet liner section 4 having the longitudinal and transverse ribs 23 and 24 projecting therefrom is fitted in the jacket projection 45. A free end of the jacket projection 45 is mated with the sealing surface $22_1$ of the seal flange 22. A mating surface thereof of the jacket projection 45 is formed into a flat sealing surface so that the molten metal does not flow in or out between the mating sealing surfaces during the die casting.

A small gap (in a range of 0.2 to 0.3 mm) is provided between the bore pin 44 and the wet liner section 4. Outer surfaces of the longitudinal and transverse ribs 23 and 24 of the wet liner section 4 are confronted or mated with the inner peripheral surface 46 of the jacket projection 45 with a small gap (in a range of 0.2 to 0.3 mm) left therebetween. A void 48 is defined between the outer surface of the liner section 4 and the inner peripheral surface 46 of the jacket pin 45, so that the molten aluminum alloy is prevented from flowing into the void 48 by the longitudinal and transverse ribs 23 and 24.

After the first to fourth wet liners $4_1$ to $4_4$ of the liner section 4 are fitted into the bore pin 44 as described above, the top and bottom movable dies 41 and 42 are moved in a closing direction. Then, by moving the side movable die 43 in a closing direction, the metal mold M is closed as shown in FIG. 13. Thus, a cavity 49 is defined by the shaping surface of the metal mold M and the cylinder liner block $B_L$. The molten aluminum alloy is poured under a predetermined pressure into the cavity 49 through a gate 50. If this molten alloy is cooled, the cylinder block $B_c$ is formed with the cylinder liner block $B_L$ integrally mounted by casting in an aluminum alloy matrix.

In pouring the molten alloy into the cavity 49 in the above-described casting process, the molten alloy cannot penetrate between the sealing surface $22_1$ of the seal flange 22 and the free end of the jacket projection 45, because jacket projection 45 is mated to the sealing surface $22_1$. Therefore, the void 48 with no molten alloy flowing thereinto is maintained between the jacket projection 45 and the first to fourth wet liners $4_1$ to $4_4$. After releasing of the metal mold M, this void 48 forms a portion of the water jacket 5. An edgewise pressure is applied to the outer peripheral surface of the jacket projection 45, as shown by an arrow a in FIG. 13, by the pressurized pouring of the molten alloy into the cavity 49, but is transmitted through the liner section 4 to the bore pin 44 having a large rigidity, thereby preventing the jacket projection 45 and the wet liner section 4 from being deformed.

The first to fifth reinforcing walls $27_1$ to $27_5$ of the reinforcing wall section 27 which is the lower portion of the cylinder liner block $B_L$ are mounted by casting in the first to fifth bearing walls $13_1$ to $13_5$ of the crank case portion $1_L$ of the cylinder block body 1.

After cooling of the molten metal, the metal mold M is released, as shown in FIG. 14, and the cylinder block $B_c$ completely molded is removed from the metal mold M. Thus, the water jacket 5 opened at the deck surface 2 is formed by the jacket projection 45 and the void.

In the wet cylinder liner block $B_L$ of the iron mounted by casting in the cylinder block body 1 of aluminum alloy in the above described manner, it is possible to improve the intrinsic function of the wet liner, i.e., the wear resistance of the cylinder bore in which the piston slides, as well as to substantially increase the rigidity of the cylinder block $B_c$ itself and particularly the bearing wall 13 of the crank case portion $1_L$ thereof and to reduce the vibration and noise of the cylinder block. It is also possible to reduce the thickness of the bearing wall, which contributes to reductions in size, weight and cost of the cylinder block $B_c$.

In addition, it is possible to reduce the phenomenon of tightening on of the aluminum alloy having a high coefficient of thermal expansion, the crankshaft $S_c$ due to the thermal shrinkage of the cylinder block when the cylinder block $B_c$ is at a low temperature, such as at the start of the engine. This contributes to a reduction in the resistance to the rotation of the crankshaft $S_c$, thereby substantially enhancing the performance of the engine in cooperation with the increase in rigidity of the bearing wall.

Figure 4:
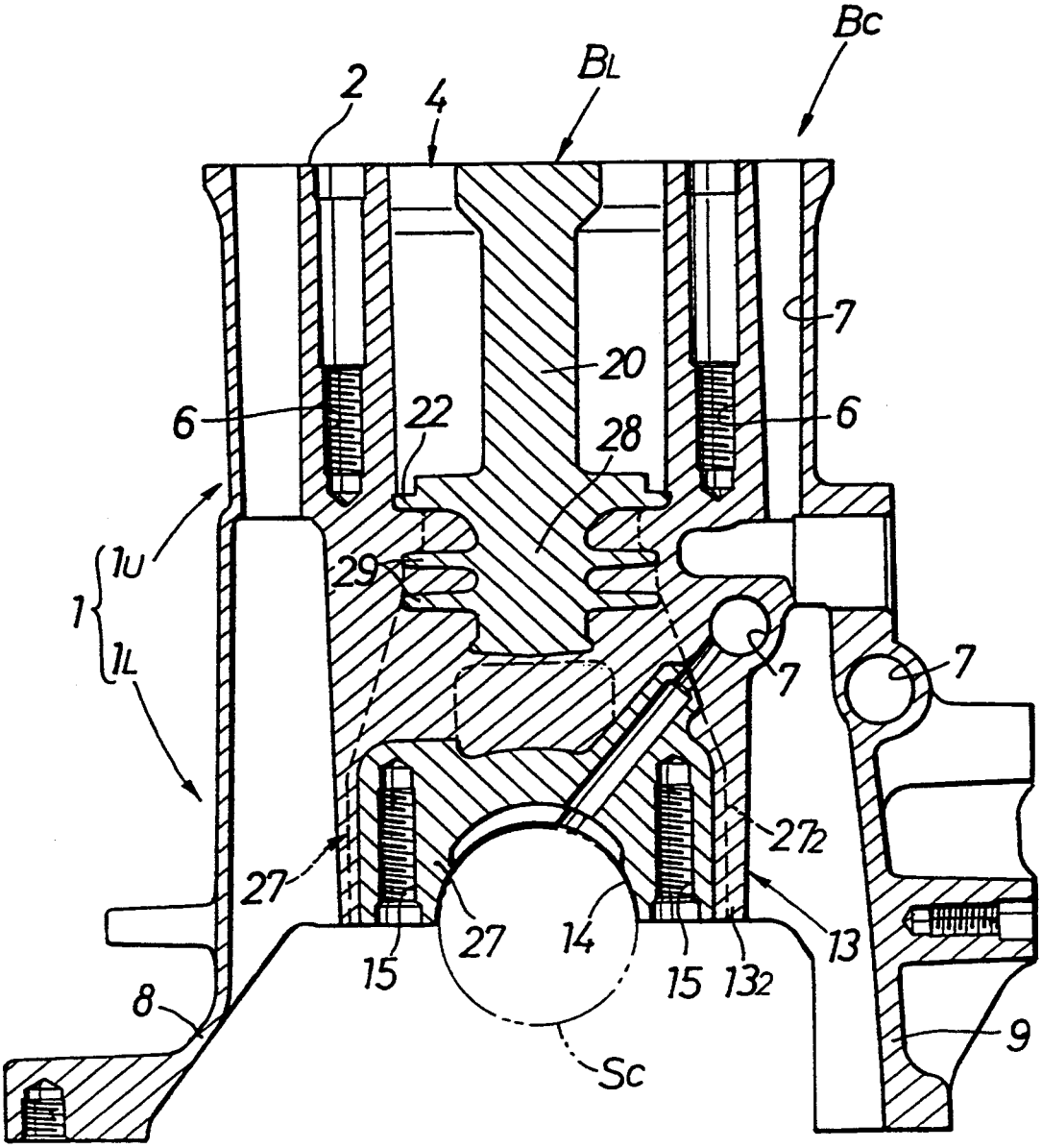
FIG. 4 is a sectional view taken along a line 4—4 in FIG. 1.

In the cylinder block $B_c$ cast in the above-described manner, the connecting portion between the bearing wall $L_B$ and the boundary wall 20 between the adjacent cylinder bores 21 is made larger in both volume and thickness than those of the other portions of the cylinder block $B_c$. However, the chiller metal portion 28 of the wet multiple cylinder liner having the chiller fins 29 is mounted by casting into this connecting portion, as shown in FIG. 4, and therefore, the chiller metal portion 28 acts as a chiller metal during the casting, thereby accelerating the solidification of the aluminum alloy matrix therearound. Therefore, it is possible to substantially equalize the solidifying rate for the thick connecting portion to the solidifying rate for the other thinner portions, so that casting defects, such as sink marks, do not result. Moreover, it is possible to increase the anchoring effect between the chiller metal portion 28 having the chiller fins 29 and the aluminum alloy of the cylinder block $B_p$.

In the above embodiment, the cylinder block has been described as being made of aluminum alloy, and the cylinder liner block as being made of cast iron. Alternatively, the cylinder block and the cylinder liner block may be formed by combination of other materials and in this case, the rigidity of the material for the cylinder liner block should be larger than that of the cylinder block.

In addition, although the cylinder liner block according to the present invention has been applied to the four-cylinder block in the above embodiment, it is a matter of course that the cylinder liner block according to the present invention can be applied to another multi-cylinder or single-cylinder block. Further, although the cylinder liner block according to the present invention has been constructed as the quadruple wet type, it is a matter of course that the cylinder liner block can be constructed into a multiple or single dry type.

What is claimed is:

1. A cylinder block comprising a cylinder block body and a cylinder liner block mounted in the cylinder block body casting the cylinder block body with the cylinder liner block positioned in the cylinder body, said cylinder liner block being formed from a material having a rigidity larger than a material forming the cylinder block body, and said cylinder liner block comprising a liner section mounted by casting in position in a cylinder barrel portion of said cylinder block body and a reinforcing wall section mounted by casting in position in a bearing wall of a crank case portion of said cylinder block body for said reinforcing wall section to support a crank shaft.

2. A cylinder block according to claim 1, wherein said cylinder block body is made of light alloy, and said cylinder liner block is made of iron.

3. A cylinder block according to claim 1, wherein said cylinder liner block is made of cast iron.

4. A cylinder block according to claim 1, wherein said cylinder liner block includes a plurality of cylinder liners in said liner section adjacent cylinder liners being connected in series through a series of common boundary walls and said reinforcing wall section includes a reinforcing wall extending downwardly from each said common boundary wall for supporting the crankshaft.

5. A cylinder block according to claim 1, wherein said cylinder liner block has an open deck surface and at least one cylinder liner extending downwardly from said open deck surface, each said cylinder liner having a seal flange projecting outwardly around an outer periphery of a lower portion of said cylinder liner for forming a lower end of a cooling water space between the cylinder liner and the cylinder block body.

6. A cylinder block according to claim 5, wherein each said cylinder liner is provided with a rib structure projecting outwardly on said outer periphery between said open deck surface and said seal flange, said rib structure projecting outwardly less than said seal flange.

7. A cylinder block comprising a cylinder liner block mounted in a cylinder block body by casting the cylinder block body with the cylinder liner block positioned in the cylinder block body, said cylinder liner block defining a plurality of cylinder bores, said cylinder liner block being comprised of cylinder liners arranged in a line, adjacent said cylinder liners being connected in series through a common boundary wall which is integrally provided with a chiller metal portion having a chiller fin, said chiller fin extending in a direction substantial perpendicular to said line of cylinder liners, said chiller metal portion and said chiller fin being mounted by casting in position in a thick wall portion of said cylinder block body for chilling said thick wall portion during casting and assisting in securing said cylinder liner block in said cylinder body block.

8. A cylinder block according to claim 7, wherein said cylinder block body is made of light alloy, and said cylinder liner block is made of iron.

9. A cylinder block according to claim 7, wherein said cylinder liner block is formed from a material having a rigidity larger than a material forming the cylinder block body.

10. A cylinder block according to claim 7, wherein said cylinder liner block has a reinforcing wall section mourned by casting in position in a bearing wall of a crank case portion of said cylinder block body for said reinforcing wall section to support a crankshaft.

11. A cylinder block according to claim 7, wherein said cylinder liner block is made of cast iron.

* * * * *